United States Patent [19]

Gerber

[11] Patent Number: 4,637,198

[45] Date of Patent: Jan. 20, 1987

[54] METHOD AND APPARATUS FOR TEMPORARILY STORING PRINTED PRODUCTS ARRIVING IN AN IMBRICATED FORMATION

[75] Inventor: Walter Gerber, Hinwil, Switzerland

[73] Assignee: Ferag AG, Hinwil, Switzerland

[21] Appl. No.: 877,130

[22] Filed: Jun. 23, 1986

[30] Foreign Application Priority Data

Jul. 1, 1985 [CH] Switzerland ..... 02930/85

[51] Int. Cl.[4] ..... B65B 63/04

[52] U.S. Cl. ..... 53/430; 53/118

[58] Field of Search ..... 53/430, 118, 117, 116, 53/119, 399, 587; 242/59, 67.1 R

[56] References Cited

U.S. PATENT DOCUMENTS

| | | | |
|---|---|---|---|
| 2,973,911 | 3/1961 | Rayburn | 53/430 X |
| 3,069,822 | 12/1962 | MacLeod et al. | 53/430 X |
| 4,127,925 | 12/1978 | Gaiser et al. | 53/430 X |
| 4,255,917 | 3/1981 | Stone | 53/430 |
| 4,494,359 | 1/1985 | Honegger | 53/118 X |
| 4,575,988 | 3/1986 | Meier | 53/118 X |
| 4,587,790 | 5/1986 | Müller | 53/118 |

*Primary Examiner*—James F. Coan

*Attorney, Agent, or Firm*—Werner W. Kleeman

[57] ABSTRACT

Printed products arriving in an imbricated formation are coiled or wound on edge, i.e., with an edge standing upright, onto a revolvingly driven hollow winding cylinder or core. The axis of rotation of this winding core is vertical or is inclined from the vertical. On the underside or bottom side of the winding core there is positioned a co-rotating discoidal support element or plate. The printed products rest or bear with their lowermost edges on this co-rotating support plate. These lowermost edges of the printed products extend substantially transverse relative to the axis of rotation of the support plate. A support strap or element is coiled or wound conjointly with and on the outer side of the imbricated formation of printed products. This support strap or element supports the printed products of the outermost winding or layer of the wound product package or storage coil.

34 Claims, 13 Drawing Figures

METHOD AND APPARATUS FOR TEMPORARILY STORING PRINTED PRODUCTS ARRIVING IN AN IMBRICATED FORMATION

BACKGROUND OF THE INVENTION

The present invention broadly relates to a new and improved method and apparatus for temporarily storing printed products or the like arriving in an imbricated formation.

Generally speaking, the present invention relates to a new and improved method for temporarily or intermediately storing printed products arriving in an imbricated formation, wherein the imbricated formation of printed products is wound or coiled into a wound product package or storage coil on a rotatably driven winding mandrel, cylinder or core.

In other words, the method of the present invention is for the intermediate storage of products arriving in an imbricated formation and comprises the steps of winding the imbricated formation up to form a wound product package or coil on a rotatably driven winding core or the like.

In its apparative aspects, the present invention concerns an apparatus for temporarily or intermediately storing printed products arriving in an imbricated formation, the apparatus having a rotatably driven winding mandrel, cylinder or core and a conveying arrangement for feeding printed products arriving in an imbricated formation to the winding mandrel, cylinder or core or to the wound product package or storage coil forming thereon.

In other words, the apparatus of the present invention is for the intermediate storage of printed products arriving in an imbricated formation and having a rotatably driven winding core and a conveying arrangement for feeding the imbricatdd product formation to either the winding core or the wound product package or coil forming thereupon.

It is known to the art that printed products arriving in an imbricated formation for temporary storage can be wound together with a winding band or strap onto a revolvingly driven or rotating winding core. This prior art is, for example, described in Swiss Pat. No. 559,691, granted Jan. 31, 1975, and German Patent Publication No. 3,123,888, published May 13, 1982 and which is cognate with the U.S. Pat. No. 4,438,618, granted March 27, 1984. The printed products, with their flat sides lying or resting substantially horizontally on a conveyor belt, are fed by this conveyor belt to the winding core. The axis of rotation of this winding core is oriented substantially horizontally. The infeed of the imbricated formation of printed products can either be to the upper portion or to the lower portion of the winding core.

In order to achieve a compact storage coil or wound product package with large storage capacity, i.e. inter alia a storage coil of large diameter, it is necessary that the printed products be fed to the winding core or the wound product package formed thereon such that the forward or leading edge of the printed products is directed towards or facing the winding core, or is facing the respective outermost winding or layer of the wound product package. Furthermore, the winding band or strap must be wound or coiled under a certain tension or tensile stress in order to cause a tightening or pulling together of the windings or layers of the storage coil during the winding process or procedure. This is indispensable for the formation of a compact wound product package or storage coil. In spite of all of these measures, the storage capacity of such storage coils formed in this known manner is limited.

SUMMARY OF THE INVENTION

Therefore, with the foregoing in mind, it is a primary object of the present invention to provide a new and improved method and apparatus for temporarily storing printed products arriving in an imbricated formation and which permit the formation of easy-to-handle wound product packages or storage coils with relatively large diameters and with correspondingly larger storage capacity than attainable by the prior art constructions.

Another and more specific object of the present invention aims at providing a new and improved method of the previously mentioned type for temporarily storing printed products arriving in an imbricated formation in which the imbricated formation of printed products is wound or coiled into a wound product package or storage coil on a rotatably or circulatingly driven winding mandrel, cylinder or core having an upstanding axis of rotation.

A further specific object of the present invention aims at providing a new and improved apparatus of the previously mentioned type comprising a circularly or revolvingly driven winding mandrel, cylinder or core equipped with a respective product separating and support element between which there are held the printed products during the winding operation, and a conveying arrangement for feeding the printed products in an imbricated formation to the winding core or the respective wound product package formed thereon.

Yet a further significant object of the present invention aims at providing a new and improved construction of an apparatus of the character described which is relatively simple in construction and design, extremely economical to manufacture, highly reliable in operation, not readily subject to breakdown or malfunction, requires a minimum of maintenance and servicing and permits the formation of large diameter and stable wound product packages or the like.

Now in order to implement these and still further objects of the invention, which will become more readily apparent as the description proceeds, the method of the present invention is manifested by the features that the imbricated formation of printed products is coiled or wound about an upstanding or substantially vertical axis, meaning a vertical axis or an axis which is inclined to the vertical by less than, for instance, 45°. The printed products are deposited with their lowermost edges extending substantially transverse to the axis of the wound product package onto a discoidal support element or plate or equivalent support structure which rotates conjointly with the winding mandrel, cylinder or core.

In other words, the method of the present invention is manifested by the features that the winding axis of the winding core is upstanding or substantially vertical, meaning vertical or inclined to the vertical, and comprises the steps of depositing the printed products upon a support plate or equivalent structure which rotates conjointly with the winding core with the lowermost edges of the printed products extending substantially transverse to the substantially vertical winding axis of the winding core.

Furthermore, the apparatus of the present invention is manifested by the features that the winding mandrel or core possesses an upstanding or substantially vertical axis of rotation, meaning a vertical axis of rotation or an axis of rotation which is inclined to the vertical by less than, for instance, 45°. Below this winding core there is provided a discoidal support element or plate or equivalent support structure for the wound product package rotatable conjointly with the winding mandrel. The printed products are brought to rest or are supported on this co-rotating support plate with their lowermost edges extending substantially transverse to the axis of rotation of the winding mandrel or core.

In other words, the apparatus the present invention is manifested by the features that the winding core possesses an axis of rotation which is substantially vertical or upstanding. A support plate for the wound product package is located below the winding core. The support plate is conjointly rotatable with the winding core. The printed products bear with their lowermost edges upon the support plate. The lowermost edges of the printed products extend substantially transverse to the axis of rotation of the winding core.

In the inventive arrangement the uprighted printed products wound about the winding core are supported on the discoidal support plate or equivalent support structure. Contrary to heretofore known solutions, it is thus not necessary to undertake special measures during the winding or coiling process for preventing the wound product package from falling apart or separating, i.e. delaminating. It will be particularly noted that the printed products can be fed in any suitable position within the imbricated formation to the winding mandrel or core or to the wound product package formed thereon. Furthermore, it is not necessary to conjointly wind or coil a winding strap or element held under considerable tension or tensile stress in order to hold together the wound product package. On the contrary, it is sufficient to support the printed products of the respective outermost winding or layer of the wound product package on the outer or outermost side. For this purpose a winding strap or band which is, for example, conjointly wound together with the printed products in imbricated formation can be utilized. This winding strap or band need, however, only be subjected to a nominal or very low tension or tensile stress.

As a result of the support of the printed products on the support plate or equivalent support structure, it is possible to produce wound product packages of very large diameter with correspondingly large storage capacity. This also permits the utilization of winding mandrels or cores of relatively or substantially large diameter without having to accept a substantial reduction of storage capacity. Winding cores of large diameter have the advantage that the printed products of the innermost winding or layer of the wound product package must not be wound as tightly and therefore are less deformed or curled, as may occur with winding cores of small diameter.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
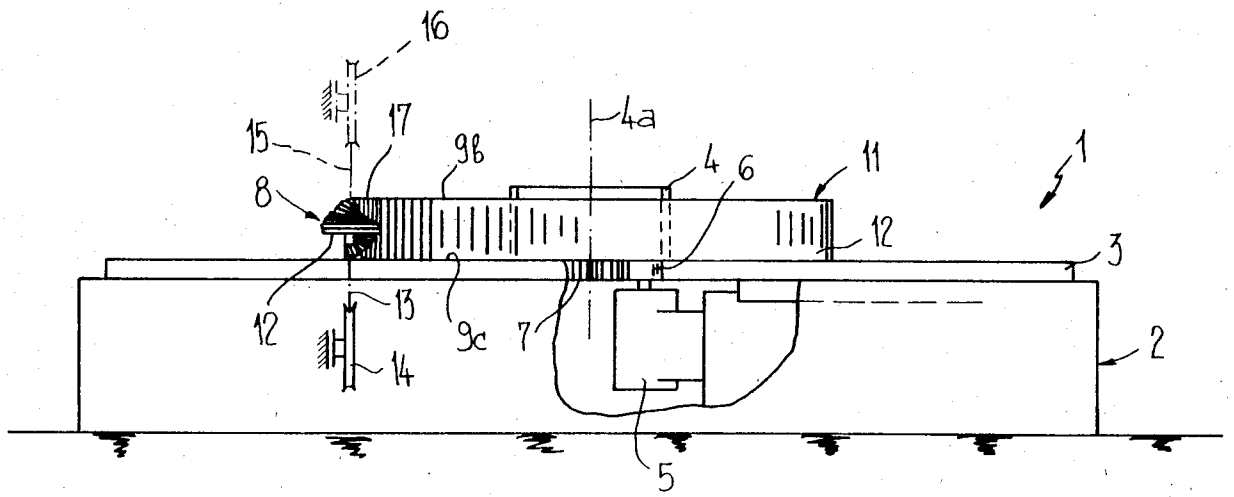
FIG. 1 is a schematic illustration in side view of a winding or coiling station for winding or coiling printed products arriving in an imbricated formation.

Describing now the drawings, it is to be understood that to simplify the showing thereof only enough of the structure of the different embodiments of winding apparatuses has been illustrated therein as is needed to enable one skilled in the art to readily understand the underlying principles and concepts of this invention. Turning now specifically to FIG. 1 of the drawings, the winding apparatus illustrated therein by way of example and not limitation and employed to realize the method as hereinbefore described will be seen to comprise a schematically illustrated winding station 1 comprising a support frame 2. Inside or within this support frame 2 there are pivotably or rotatably positioned a support structure, here shown as a discoidal support plate or element 3 and a substantially hollow cylindrical winding mandrel, cylinder or core 4 which is firmly affixed to or connected with the support plate 3. The support plate 3 and the winding core 4 are rotatably or circulatingly driven by a drive assembly 5 to revolve in the direction of the arrow A (cf. FIG. 2) about an upright or substantially vertical axis of rotation 4*a*, upright or substantially vertical meaning vertical or inclined to the vertical by less than, for instance, 45°, which axis coincides with the longitudinal axis of the winding mandrel or core 4. For this purpose the drive assembly 5 of the illustrated embodiment is provided with a drive pinion or gear 6 which meshes or engages with an internal toothing or gearing 7 of the support plate 3. It will be noted that other suitable means can also be used as drive means for driving the support plate 3 or equivalent support structure and the winding mandrel or core 4.

Printed products 9 arriving in an imbricated formation 8 are wound onto the winding mandrel or core 4. According to the embodiments shown in FIGS. 1 and 2, the printed products 9 are fed or conveyed in a reclining position, that is to say with substantially horizontally flat sides, in the direction of the arrow B (cf. FIG. 2). The printed products 9 possess a leading edge 9*a*. This leading edge 9*a* can either lie on the upper side or on the lower side of the imbricated formation 8 and can either be the folded or spine edge or the open or fan edge opposite this folded edge. The lateral or end edges of the printed products 9 extending substantially at right angles to this leading edge 9*a* are designated by reference numerals 9*b* and 9*c*. The imbricated formation or imbricated product formation 8 is deposited against or laid on the winding core 4 or a wound product package or storage coil 11 forming thereupon at a transfer location or point 10.

Figure 2:
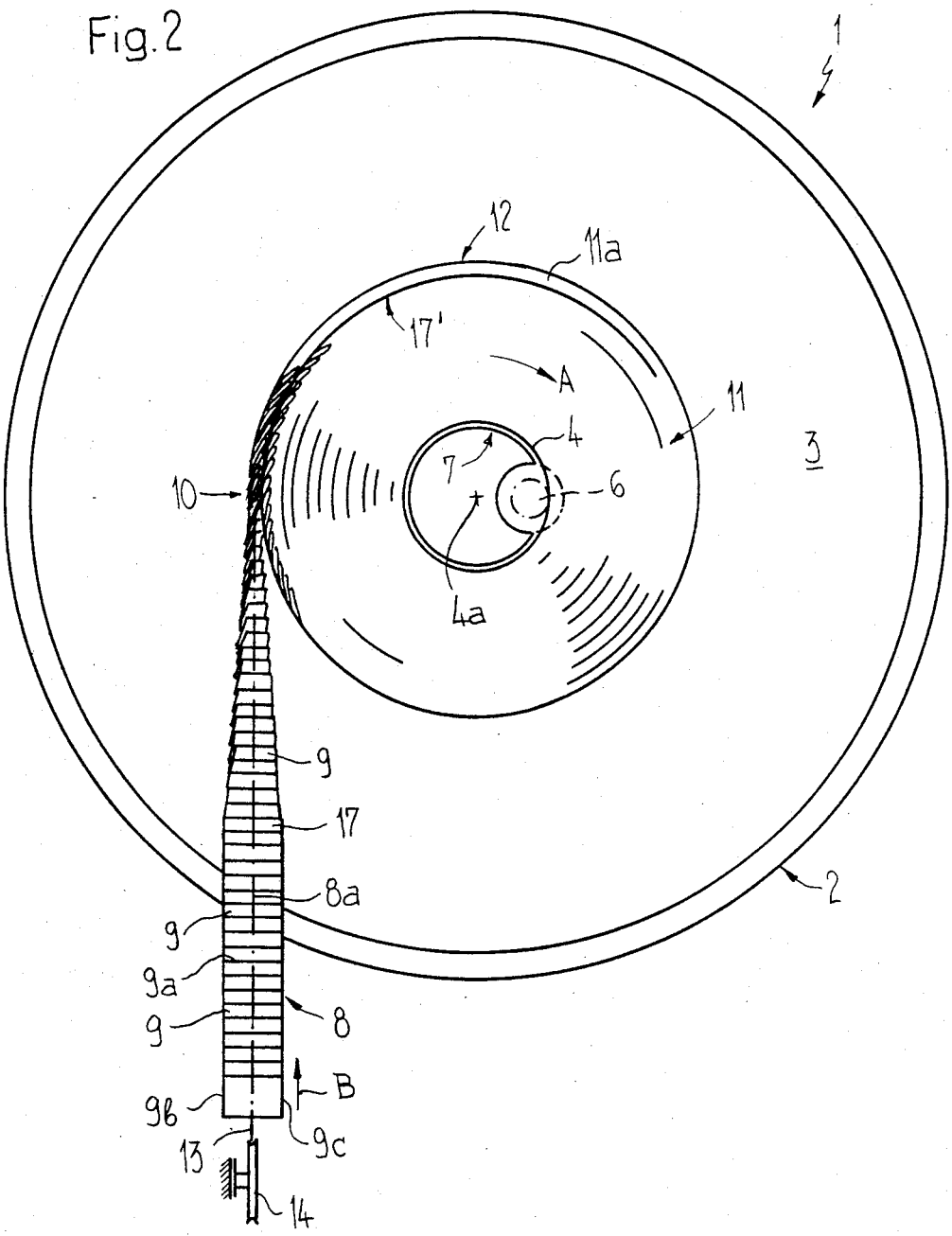
FIG. 2 is a top plan view of the winding or coiling station of FIG. 1 for winding or coiling printed products arriving in an imbricated formation.

As can be seen from FIGS. 1 and 2, the imbricated formation 8 is turned or rotated through an angle of substantially 90° about its longitudinal axis 8*a* in a region which lies before or downstream of the transfer location 10 as seen in its direction of conveyance B. This operation is executed such that the printed products 9 are deposited upright, i.e. these products extend vertically or upright, onto the winding core 4 or the wound product package 11 forming thereupon i.e. the outermost winding or layer 11*a* thereof. The conveyance or feeding and turning or rotation of the imbricated formation 8 is accomplished by means of a conveying arrangement of suitable construction which is not particularly shown in FIGS. 1 and 2. This conveying arrangement may, for example, be formed or constructed by means of conveyor belts or straps.

A support or retention element or strap 13 comprising an elongated flexible support element and travelling on the underside 12 of the imbricated formation 8 is wound or coiled conjointly with the imbricated formation 8. This support strap or band 13 is unwound or uncoiled from a supply roll or reel 14 upon which a slight braking pressure or force is applied in a conventional manner not particularly further described here. After the imbricated formation 8 is turned or rotated, the underside 12 thereof and also the support strap or band 13 now come to lie on the outer side or periphery i.e. the currently outermost winding or layer 11*a* of the wound product package 11. As just stated, this support strap or band 13 serves to support the printed products 9 at this outermost winding or layer 11*a* of the wound product package or coil 11. A tipping or falling over of the substantially upright or standing printed products 9 is thus prevented.

As is illustrated with a dashed line in FIG. 1, a or partitioning or separating strap or element 15 comprising an elongated, flexible partitioning element can additionally be conjointly wound or coiled together with the imbricated formation 8. This partitioning or separating strap 15 is unwound from a supply roll or reel 16 which likewise has a light braking force applied thereto in conventional manner. This partitioning strap 15 is applied to or laid upon an upper side 17 of the conveyed imbricated formation 8. This upper side 17 becomes an inner side 17' (see FIGS. 2 and 4) of the imbricated formation 8 confronting the winding mandrel or core 4 after rotation or turning of the imbricated formation 8. The partitioning strap or band 15 which runs on the inner side 17' of the wound product package or coil 11 serves to facilitate the later unwinding or uncoiling and separation of the imbricated formation 8 from the wound product package or coil 11.

The printed products 9 wound or coiled standing substantially upright lie with their now lowermost edges 9*c* on the support plate 3. This support plate 3 bears or supports the weight of the wound product package or coil 11.

The diameter of the wound product package or coil 11 increases or becomes greater during the winding or coiling process so that either the position of the winding mandrel or core 4 or that of the transfer location 10 must be adjustable or movable. Accordingly, suitable preferred embodiments for accomplishing such result will be discussed hereinbelow in relation to FIGS. 3 and 4.

Figure 3:
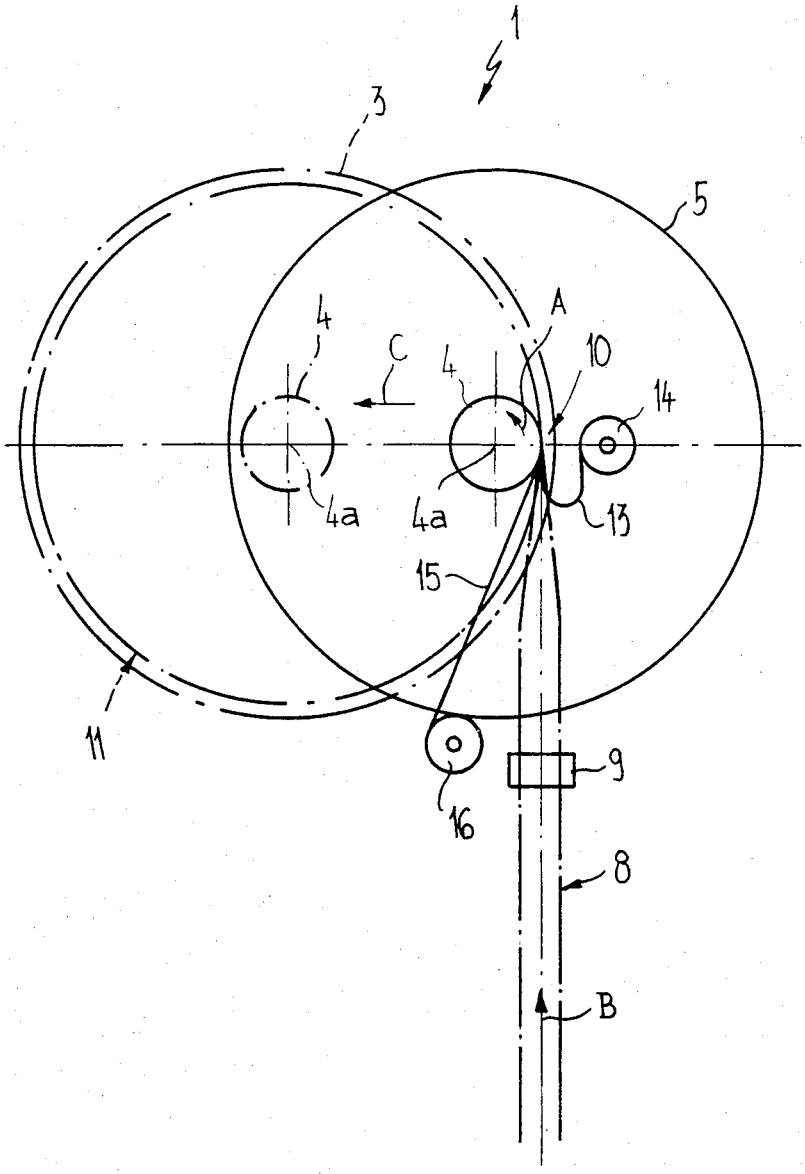
FIG. 3 is a top plan view of a further embodiment of a winding station having a displaceable winding core.

There is shown in FIG. 3 an analogous illustration of a winding station 1 which is drawn even more schematically than in FIG. 2. In this embodiment the location of the transfer location 10 remains stationary while the winding mandrel or core 4 together with the wound product package 11 and the support plate 3 are displaceable in the direction of the arrow C. This displacement occurs during the winding or coiling operation and corresponds to the increasing size of the diameter of the wound product package 11. The position of the support plate 3 and the winding mandrel or core 4 of a finished or completed wound product package or coil 11 is indicated with dotted and dashed lines.

Figure 4:
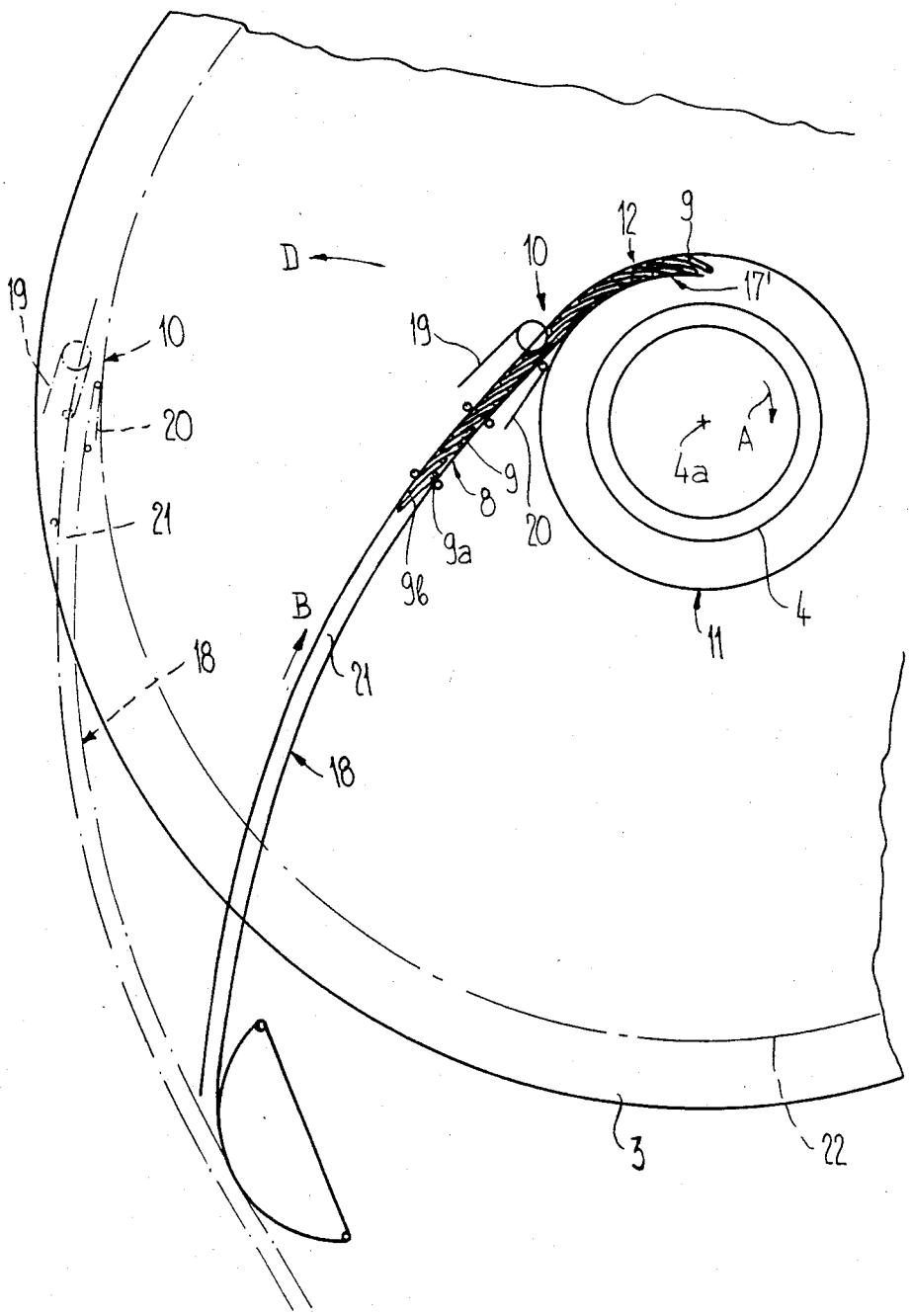
FIG. 4 is a top plan view of yet another embodiment of a winding station comprising a pivotable infeed conveyor.

A top plan view of an embodiment of a winding station is shown in FIG. 4, wherein the winding mandrel or core 4 and the support plate 3 have stationary locations and in which the transfer location 10 is correspondingly displaced or moved relative to the winding mandrel or core 4 by the increasing diameter of the wound product package 11. In this embodiment the printed products 9 of the imbricated formation 8 are already uprightly oriented or arranged on edge by the infeed or conveying arrangement, that is to say the printed products 9 are supplied or fed in an upright or substantially vertical orientation. The leading edges 9*a* of the printed products 9 are fed or conveyed towards the winding mandrel or core 4 and in a position facing the winding mandrel 4 or the wound product package 11 formed thereon. A schematically illustrated rocker conveyor or pivoting or swinging conveyor 18 of the conveying arrangement is pivotable in the direction of the arrow D. This pivoting or swinging conveyor 18 comprises two opposing or oppositely arranged conveyor belts or straps 19 and 20 which are only partially illustrated. These conveyor belts or straps 19 and 20 form between themselves a conveying channel 21 through which the imbricated formation 8 is conveyed in the direction of the arrow B towards the wound product package 11. The printed products 9 leaving or exiting the conveying channel 21 in the region of the transfer location 10 are applied to or deposited upon the wound product package 11. The support strap or band 13 wound conjointly with the imbricated formation 8 and also the optional or possibly provided partitioning strap 15 are not illustrated in FIG. 4. The pivoting or swinging conveyor 18 is illustrated in dotted and dashed lines in its outermost final or angular end position, which it assumes when the wound product package or coil 11 is completed or finished. The circumference or periphery of this completed wound product package 11 is indicated by a dotted and dashed line 22. The construction or design of the pivoting or swinging conveyor 18 is such that the imbricated formation 8 is fed approximately with the same angle onto the wound product package 11 during all pivotable positions of such pivoting or swinging conveyor 18.

Figure 5:
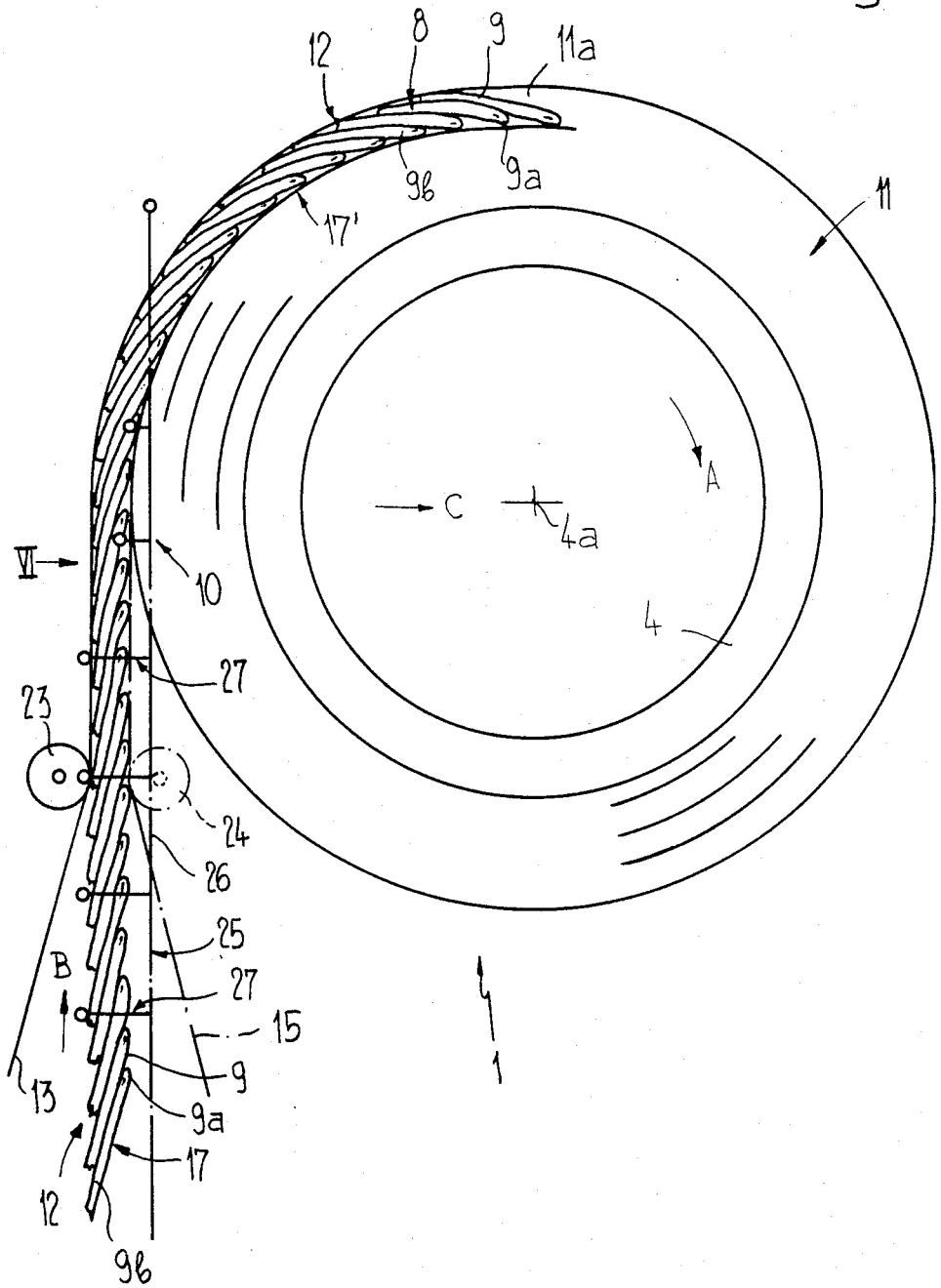
FIG. 5 is a top plan view of a still further embodiment of a winding station with a displaceable winding core.
Figure 6:
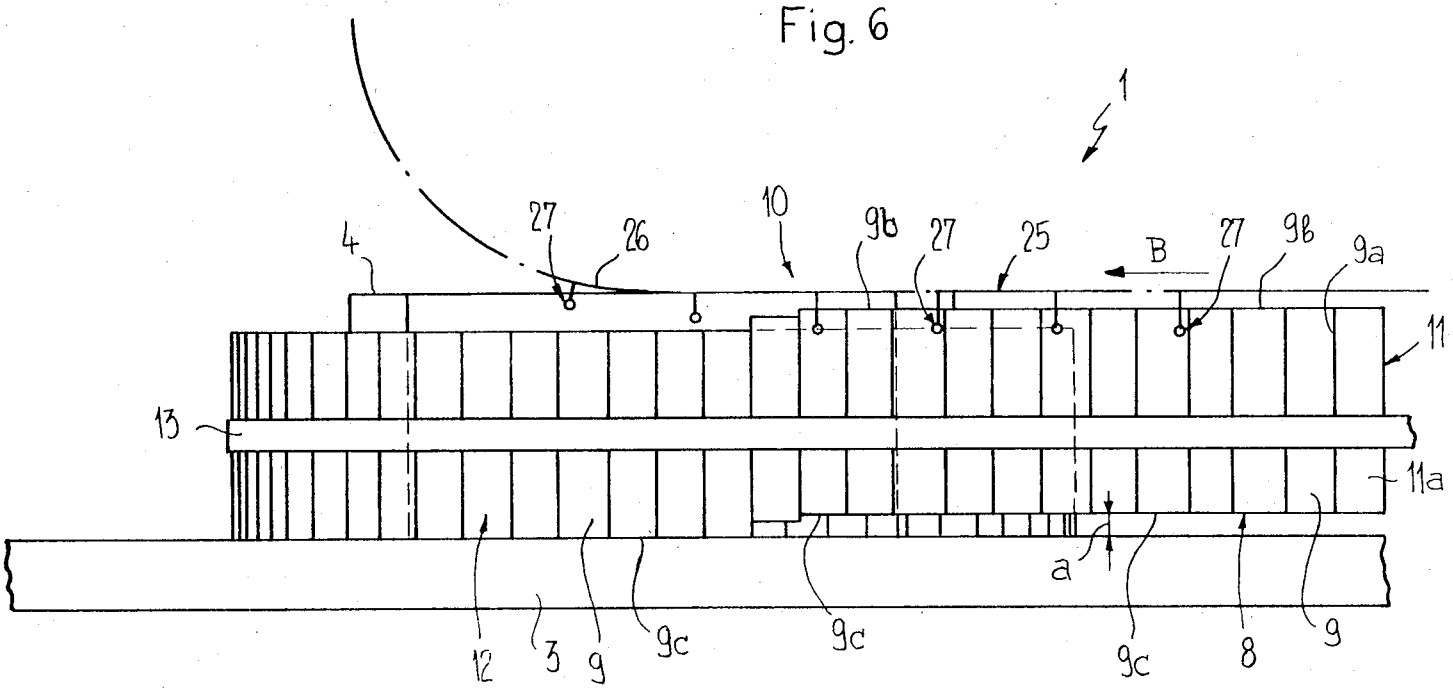
FIG. 6 is a side view of the embodiment of winding station shown in FIG. 5 viewed in the direction of the arrow VI.

FIG. 5 is a top plan view of a further embodiment of a winding station 1 and FIG. 6 is a side view of FIG. 5 viewed in the direction of the arrow VI. The infeed or conveyance of the printed products 9 in these embodiments occurs by means of a transport device 25. This transport device 25 comprises clamps or grippers 27 which are spaced in mutual separation and are attached on a circulatingly driven or revolving traction member 26. These clamps or grippers 27 are only schematically illustrated. These clamps or grippers 27 hold the imbricated formation 8 in a substantially upright position or orientation and grip the printed products 9 in the region of their now uppermost side edges 9*b* (cf. FIG. 6). The support strap or band 13 and, if provided, also the partitioning strap 15 are continuously applied to or deposited upon the respective outer side 12 and inner side 17 of the imbricated formation 8 before or upstream of the transfer region 10 by means of guide rolls 23 and 24.

As can be especially well seen in FIG. 6, the printed products 9 fed by means of the transport device 25 are suspended at the region of their uppermost edges 9*b* and continuously travel over the support plate 3 or equivalent structure. The lowermost edges 9*c* are thus elevated above the support plate 3 by a distance a. On the one hand, it is thus avoided that the printed products 9 contact or impact against the edge of the support plate 3. On the other hand, it is thus guaranteed that the printed products 9 do not enter into contact with the support plate 3 with their lowermost edges 9*c* during their transport, which could damage the printed products 9.

The clamps or grippers 27 are appropriately opened at the transfer location 10 at which the imbricated formation 8 comes into contact with the winding mandrel or core 4 or with the wound product package 11 formed thereon. The released printed products 9 fall as a result of their own weight downwardly and come to rest with their lowermost edges 9*c* on the support plate 3. The support strap or band 13 prevents a falling-away of the released printed products 9.

In this embodiment, the transfer location 10 remains at the same location during the entire winding or coiling process while the winding core 4 together with the support plate 3 is moved in the direction of the arrow C (cf. FIG. 5) as already explained in relation to FIG. 3.

Figure 7:
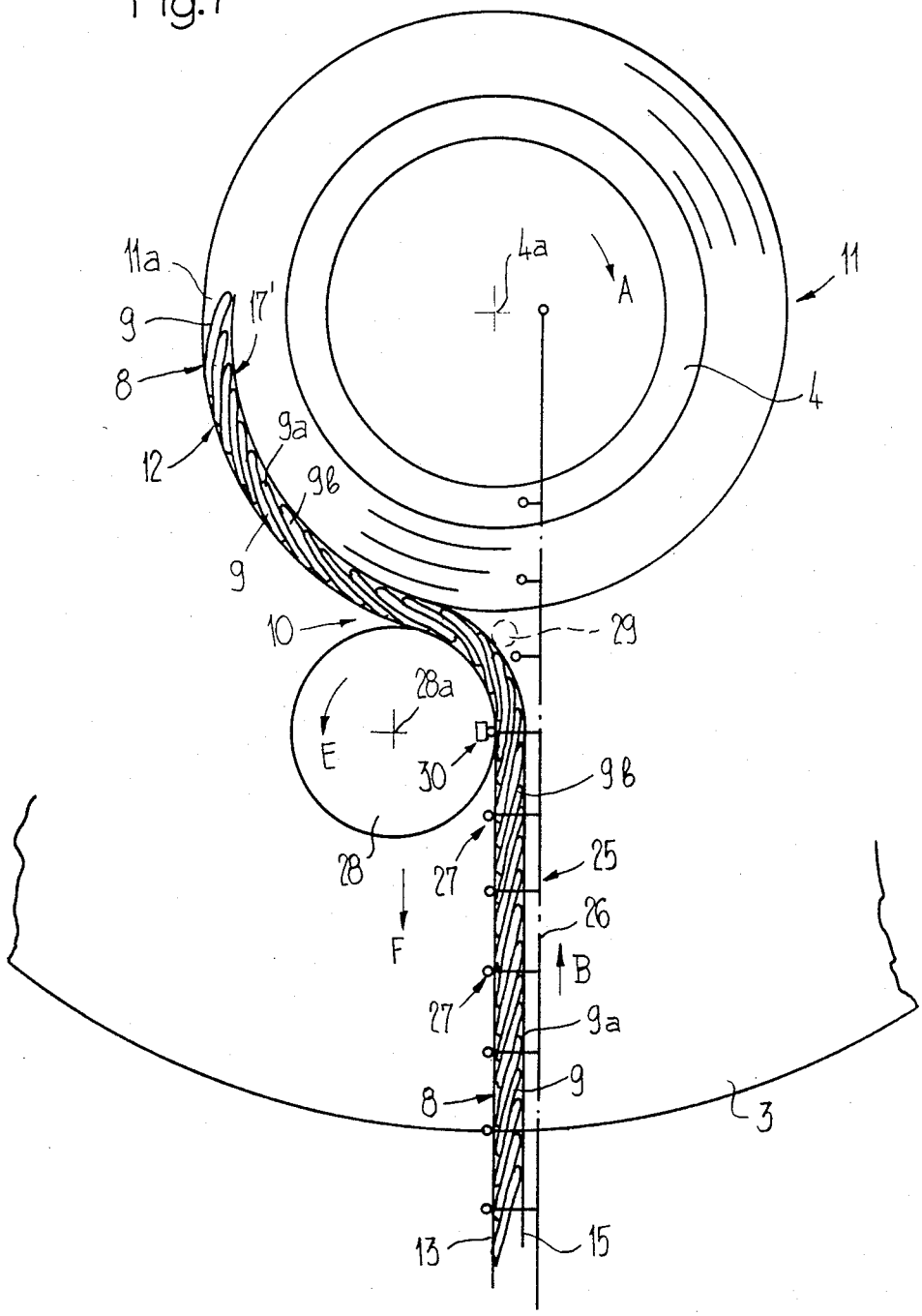
FIG. 7 is a top plan view of a still further embodiment of a winding station having a winding core which has a positionally fixed winding mandrel or core.
Figure 8:
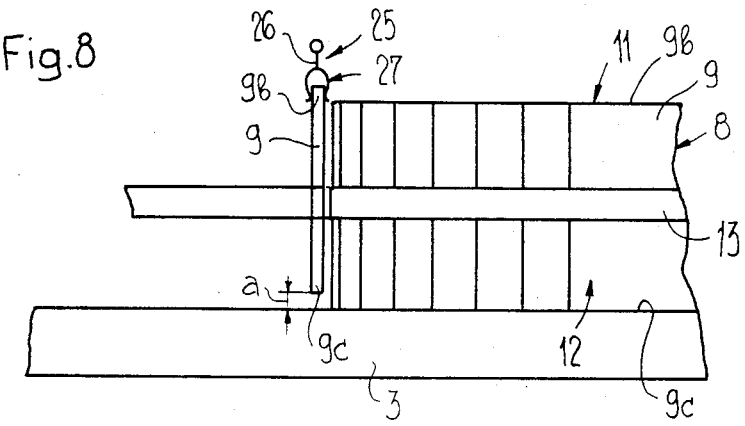
FIGS. 8–13 illustrate side views of different types of means for feeding or conveying the printed products to the winding core or to the wound product package formed of the heretofore considered embodiments of winding stations depicted in FIGS. 1 to 7 thereon.

In comparison thereto, the position of the winding mandrel or core 4 and the support plate 3 of the embodiments according to FIG. 7 does not change during the winding operation. The printed products 9 are fed or conveyed by a transport device 25 in the same manner as in the embodiments according to FIGS. 5 and 6. These printed products 9 travel or are conveyed above the support plate 3 or equivalent support structure and are separated therefrom by a suitable spacing or separation distance. The imbricated formation 8 is fed between a capstan or guide roller 28 and the wound product package 11 before being coiled or wound onto the wound product package 11, that is to say before or upstream of the transfer location 10. This guide roller 28 rotates about its axis 28*a* in the direction of the arrow E. An opening device 30 for the clamps or grippers 27 is schematically illustrated and positioned in the region where the imbricated formation 8 is fed to and comes into contact with the guide roller 28. As the clamps or grippers 27 pass by this opening device 30, they are opened and the printed products 9 are released or freed. The released printed products 9 travel between the guide roller 28 and the wound product package 11 or, if necessary, also between a support roll or element 29 located in the vicinity of the transfer location 10. These released printed products 9 are then fed to the transfer location 10 and are thereafter fed or deposited onto the winding mandrel or core 4 or the wound product package 11 formed thereon. The imbricated formation 8 is held between the support strap 13 and the partitioning strap 15.

As the diameter of the wound product package 11 increases, the guide roller 28 and the support roll or roller 29, as well as the opening device 30, are moved in the direction of the arrow F away from the winding mandrel or core 4.

Referring to FIGS. 8–13, further possibilities or alternatives for feeding and depositing the printed products 9 onto the winding mandrel or core 4 or the wound product package 11 formed thereon will be explained hereinbelow. In these FIGS. 8–13, however, only those portions of the winding station 1 are illustrated which are necessary for understanding the invention.

In the embodiments according to FIGS. 8–11, the printed products 9 are fed by means of the transport device 25 in the same manner as described in relation to the aforementioned embodiments. That is to say the clamps or grippers 27 of the transport device 25 hold the printed products 9 on their uppermost edges 9*b*. According to the embodiment shown in FIG. 8, the printed products 9 are fed in an upright or substantially vertically suspended or hanging position in the same manner as in the embodiment according to FIGS. 5 and 6. The printed products 9 travel above the support plate 3. Their lowermost edges 9*c* are spaced from the support plate 3 by a spacing or distance a. The printed products 9 are released at the transfer location 10 and come to rest with their lowermost edges 9*c* on the support plate 3. Subsequently they are deposited on the wound product package 11.

Figure 9:
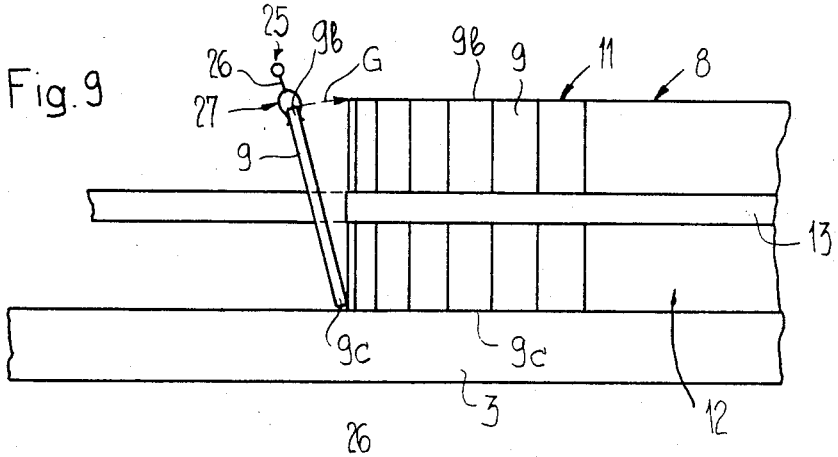
Figure 11:
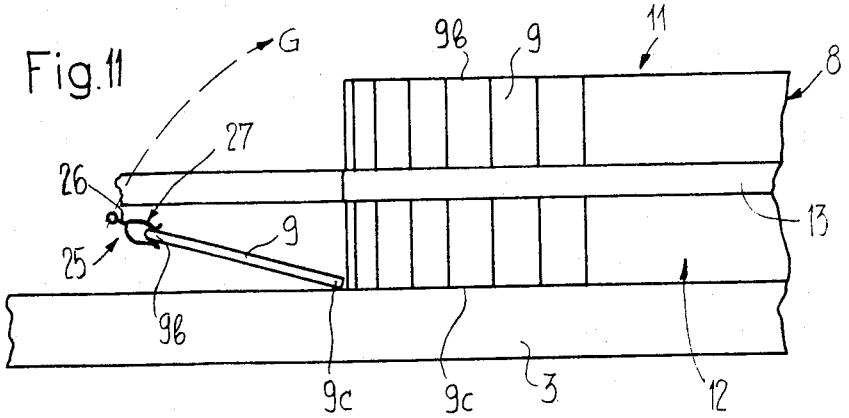

According to the variants shown in FIGS. 9 and 11, the printed products 9 are fed in a more or less pronounced inclined or sloping position relative to the vertical. The printed products 9 are first deposited with their lowermost edges 9*c* onto the support plate 3 at the transfer location 10 disposed at the circumference or periphery of the wound product package 11. Then, by swinging the uppermost product edge 9*b* in the direction of the arrow G, the printed products 9 are completely deposited onto the wound product package or coil 11.

Figure 10:
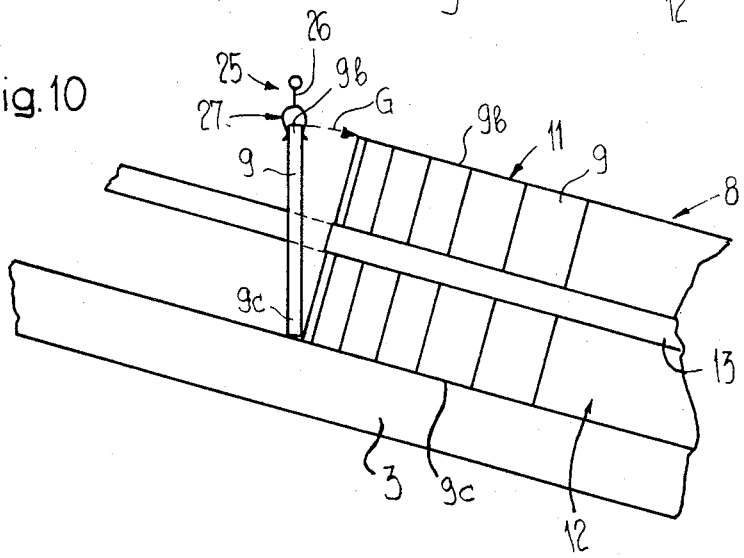

According to the variant shown in FIG. 10, the support plate 3 or equivalent support structure and thus also the winding mandrel or core 4 are inclined or slanted, that is to say are inclined relative to the vertical. The printed products 9 are fed by means of the transport device 25 in a substantially vertically suspended or upright position in the same manner as in the embodiment shown in FIG. 8. The deposition of the printed products 9 onto the wound product package 11 is accomplished, however, in the same manner as previously described in relation to FIGS. 9 and 11. The printed products 9 are first deposited onto the support plate 3 with their lowermost edges 9*c* and are thereafter then brought into contact with the wound product package 11.

The deposition of the printed products 9 onto the wound product package 11 can take place by means of various suitable methods. For example, the guide means of the transport device 25 can be formed such that the printed products 9 are brought into contact with the respective wound product package 11 or the winding mandrel or core 4. It is also possible, however, to provide additional means for guiding or deflecting the printed products 9 such as, for example, conveying belts or sheet metal deflectors, guides or baffle plates. Furthermore, the support strap or band 13 can also be utilized for placing the inclined printed products 9 onto the wound product package 11.

Figure 12:
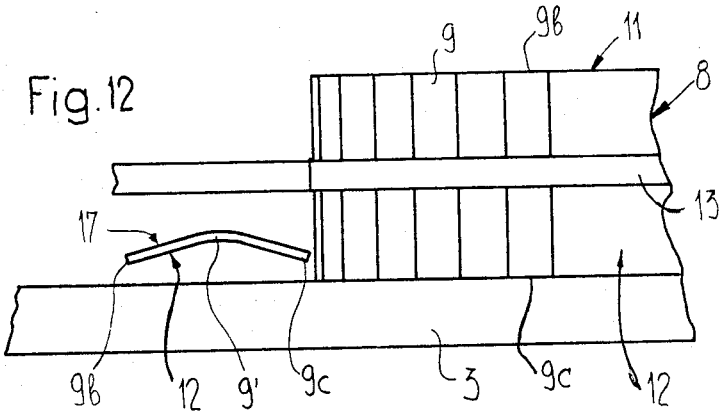

According to the variant shown in FIG. 12, the printed products 9 are fed in a substantially reclining position similar to that shown in FIGS. 1 and 2. However, the printed products 9 shown in FIG. 12 are bent in the shape of a peaked-roof as is shown in FIG. 12 in relation to the printed products 9'. The deposition of these printed products 9', which are bent in the shape of a peaked-roof, onto the wound product package 11 is executed in a manner similar to that described in relation to FIGS. 1 and 2. First, the half of the printed products 9' which face the wound product package 11 are placed onto the wound product package 11 and then, thereafter, the other half of the printed products 9' are placed onto the wound product package 11.

Figure 13:
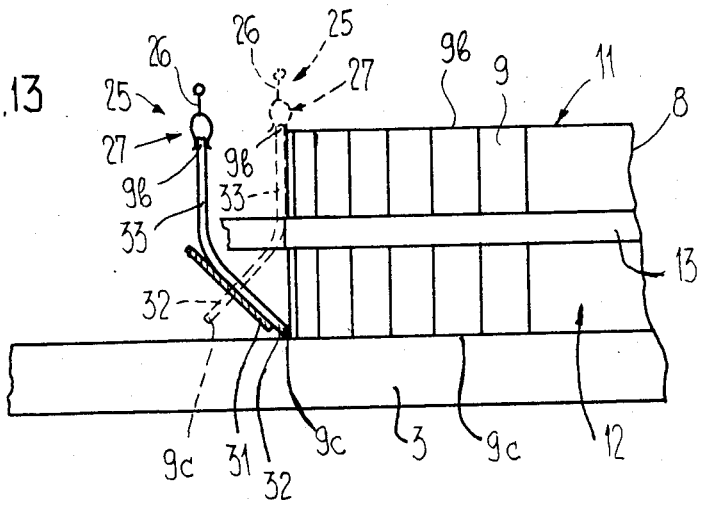

According to the embodiment shown in FIG. 13, a deflecting panel or baffle 31 or the like is provided onto which the printed products 9 run or come into contact with. This deflecting panel 31 causes a deflection of a lower portion 32 of the printed product 9 away from the vertical product plane or position of the printed product 9. By means of this deflection of the lower portion 32 of the printed product 9 with respect to an opposite upper portion 33 of the printed product 9, the lowermost edge **9*c* is raised or elevated to the extent that it does not come into contact with the lateral edge of the support plate 3. The lowermost edge 9*c* also does not come into contact with the support plate 3 during transport over the support plate 3. Similar to the embodiments according to FIGS. 9 to 11, the printed products 9 at the transfer location 10 first rest upon the winding mandrel or core 4 or the wound product package 11 formed thereon only in the region of their lowermost edges 9*c*. Subsequently the printed products 9 are then completely pressed onto the respective wound product package 11 or the winding mandrel or core 4**.

According to FIG. 13, a variant is shown in dashed lines in which the lower portion 32 of the printed product 9 is deflected away from the wound product package 11. At the same time the upper portion 33 of the printed product 9 is brought forward onto the wound product package 11 by means of the transport device 25. The deflection of the lower portion 32 of the printed product 9 occurs in the same manner as in the variant illustrated in solid lines, that is to say, for example, likewise with the assistance or aid of a baffle or deflection plate. According to the variant illustrated in dashed lines, the upper portion 33 of the printed product 9 is first placed onto the wound product package 11. The lower portion 32 of the printed product 9 automatically comes into contact or comes to rest on the wound product package 11 after release by means of the deflecting plate as a result of the inherent resiliency of the printed products 9. Under certain conditions, however, guide means must also be provided for depositing the lower portion 32 of the printed products 9 on the wound product package 11.

These guide means, together with the winding mandrel or core 4 and the support plate 3 of the winding station 1 can be removed after the wound product package 11 has been produced and can be brought either directly or via an intermediate storage area or warehousing area to an unwinding or uncoiling station. The unwinding of the imbricated formation 8 from the wound product package 11 is accomplished by means of unwinding or uncoiled the support strap or band 13 and the partitioning strap or band 15. The unrolled printed products 9 are received by a suitably constructed conveyor or conveyor apparatus and fed or conveyed to a further processing station.

Only a few of many possible embodiments have been explained in relation to the previously described Figures. Several further variants will also be briefly mentioned hereinbelow.

The position of the printed products 9 within the imbricated formation 8 is not important for trouble-free formation of a wound product package or coil 11. It is therefore unimportant or irrelevant whether or not the leading edges **9*a* of the printed products 9 face the winding mandrel or core 4. The feeding or conveying of the printed products 9 to the winding mandrel or core 4 or the wound product package 11** formed thereon can optionally take place by means of strap or belt conveyors or by means of conveyors possessing clamps or grippers or even in another suitable manner.

Furthermore, it is possible to drive the winding mandrel or core 4 and the support plate 3 not at the center or middle portion thereof but from the periphery or circumference of the support plate 3 or from the periphery or circumference of the wound product package 11. If, however, the drive is accomplished at the periphery of the wound product package coil 11, there then exists a certain danger of damaging the printed products 9.

The support strap or band 13 is not necessary if the printed products 9 of the outermost winding or layer **11*a* of the wound product package 11 are supported by a different means or in a different manner. This can be accomplished, for example, by means of a support strap or band extending along the circumference of the wound product package 11 and which support strap or band revolves or rotates in the same direction as the wound product package or coil 11. This support strap is provided with a length-compensating device in order to be able to adjust or accommodate increasing diameter sizes of the wound product package or coil 11**.

Furthermore, it will be understood that in lieu of the support straps or bands 13 and the partitioning straps or bands 15, other suitable elements, for example cords and the like can also be utilized. Synthetic or plastic foil or thin sheets are preferably utilized as the support straps or bands 13 and the partitioning straps or bands 15.

While there are shown and described present preferred embodiments of the invention, it is to be distinctly understood that the invention is not limited thereto, but may be otherwise variously embodied and practiced within the scope of the following claims. Accordingly,

What I claim is:

1. A method for the intermediate storage of printed products arriving in an imbricated formation, comprising the steps of:

winding the imbricated formation up to form a wound product package on a rotatably driven winding core about an upright winding axis of said winding core; and depositing the printed products upon a support structure which rotates conjointly with the winding core, with the lowermost edges of the printed products extending substantially transverse to said upright winding axis of said winding core.

2. The method as defined in claim 1, wherein:

said step of winding entails supporting a currently outermost winding of said wound product package on an outer side thereof.

3. The method as defined in claim 1, wherein:

said step of winding entails winding a long flexible support element conjointly with the imbricated formation onto an outer side of said winding core.

4. The method as defined in claim 3, wherein:

said flexible support element comprises a support strap.

5. The method as defined in claim 3, wherein:

said support element comprises support cord.

6. The method as defined in claim 1, comprising the further step of:

winding a long flexible partitioning element conjointly with said imbricated formation on a side of the imbricated formation confronting said winding core.

7. The method as defined in claim 6, wherein:

said partitioning element comprises a partitioning strap.

8. The method as defined in claim 6, wherein:

said partitioning element comprises a partitioning cord.

9. The method as defined in claim 1, wherein:

said step of depositing entails depositing the printed products upon said support structure only upon contact with either said winding core or said wound product package forming thereupon.

10. The method as defined in claim 1, comprising the further steps of:

feeding the imbricated formation with the printed products lying approximately horizontally; and rotating the imbricated formation about a longitudinal axis thereof such that the printed products are substantially upright before the printed products arrive at said winding core or said wound product package forming thereupon.

11. The method as defined in claim 1, comprising the further steps of:

feeding the imbricated formation with the printed products in an upright position; and depositing the printed products onto said support structure during winding onto either said winding core or said wound product package forming thereupon.

12. The method as defined in claim 1, comprising the further steps of:

feeding the imbricated formation with the printed products in a substantially inclined position relative to the vertical onto either said winding core or said wound product package forming thereupon; and subsequentally depositing the printed products initially in the region of lowermost edges thereof and then fully onto either said winding core or said wound product package forming thereupon.

13. The method as defined in claim 12, wherein:

said printed products are bent in a substantially peaked-roof shape.

14. The method as defined in claim 12, comprising the further steps of:

deflecting a region of the printed products associated with said lowermost edge of said printed products before winding the printed products onto either said winding core or said wound product package forming thereupon from a plane of the printed products in a direction either toward or away from said wound product package.

15. The method as defined in claim 1, comprising the further steps of:

depositing the imbricated formation at a substantially stationary transfer location on either said winding core or said wound product package forming thereupon; and displacing said winding core as a function of an increasing diameter of said wound product package.

16. The method as defined in claim 1, wherein:

said winding core is stationarily located; and depositing said imbricated formation onto either said stationarily located winding core or said wound product package forming thereupon at a displaceable transfer location which is moved away from said winding core with increasing diameter of said wound product package.

17. The method as defined in claim 1, wherein:

said upright winding axis extends vertically.

18. The method as defined in claim 1, wherein:

said upright winding axis extends in an inclined orientation of at most 45° relative to the vertical.

19. An apparatus for the intermediate storage of printed products arriving in an imbricated formation, comprising:

rotatably driven winding core for forming a wound product package thereon;

a conveying arrangement for feeding the imbricated formation to either the winding core or the wound product package forming thereupon, wherein:

said winding core possesses an upright axis of rotation;

support means for said wound product package and located below said winding core;

said support means being conjointly rotatable with said winding core;

the printed products bearing with lowermost edges thereof upon said support means; and said lowermost edges of the printed products extending substantially transverse to said upright axis of rotation of said winding core.

20. The apparatus as defined in claim 19, further including:

an elongated and substantially flexible support element connected to said winding core;

a supply reel;

said elongated and substantially flexible support element being unwindable from said supply reel; and said elongated and substantially flexible support element being wound continuously and conjointly with the imbricated formation onto an outer side of said winding core.

21. The apparatus as defined in claim 20, wherein:

said support element comprises a support strap.

22. The apparatus as defined in claim 20, wherein:

said support element comprises a support cord.

23. The apparatus as defined in claim 19, further including:

an elongated and substantially flexible partitioning element connected to said winding core;

a supply reel;

said elongated and substantially flexible partitioning element being unwindable from said supply reel; and said elongated and substantially flexible partitioning element being wound continuously and conjointly with the imbricated formation on a side of the imbricated formation facing said winding core.

24. The apparatus as defined in claim 23, wherein:

said partitioning element comprises a partitioning strap.

25. The apparatus as defined in claim 23, wherein:

said partitioning element comprises a partitioning cord.

26. The apparatus as defined in claim 19, wherein:

said conveying arrangement comprises a transport device provided with a revolvingly drivable traction member;

grippers arranged in mutual succession on said traction member; and said grippers grasping the printed products on an uppermost edge thereof as seen in a predetermined direction of conveyance of the printed products.

27. The apparatus as defined in claim 26, wherein:

said transport device serves for continuously feeding the printed products in a suspended manner and with said lowermost edges separated by a predetermined distance from said support means; and said transport device serving for releasing said printed products in a predetermined product transfer region onto either said winding core or said wound product package forming thereupon.

28. The apparatus as defined in claim 26, wherein:

said transport device serves for feeding said printed products in a substantially inclined position relative to the vertical onto either said winding core or said wound product package forming thereupon; and means for initially depositing said lowermost edges of the printed products onto either said winding core or said wound product package forming thereupon.

29. The apparatus as defined in claim 26, further including:

means for deflecting said printed products in a direction selectively either towards or away from either said winding core or said wound product package forming thereupon before depositing said printed products onto either said winding core or said wound product package forming thereupon.

30. The apparatus as defined in claim 19, wherein:

said conveying arrangement comprises conveying means for guiding said imbricated formation to either said winding core or said wound product package forming thereupon.

31. The apparatus as defined in claim 19, further including:

a transfer location of said printed products from said conveying arrangement to either said winding core or said wound product package forming thereupon and defining a stationary transfer location; and said winding core being adjustable with increasing diameter of said wound product package.

32. The apparatus as defined in claim 19, wherein:

said winding core possesses a stationary location; and a transfer location of said printed products from said conveying arrangement to either said winding core or said wound product package forming thereupon being changeable in location as a result of increasing diameter of said wound product package.

33. The apparatus as defined in claim 19, wherein:

said support means is substantially discoidal.

34. The apparatus as defined in claim 19, wherein:

said support means is connected with said winding core.

* * * * *